United States Patent [19]

Santalucia et al.

[11] Patent Number: 4,899,662

[45] Date of Patent: Feb. 13, 1990

[54] CONTAINER-DISPERSER FOR CHAFF CONSTITUTED BY METAL STRIPS OR BY METALLIZED STRIPS

[75] Inventors: André R. G. Santalucia, Muret; Gilbert Demarest, Portet sur Garonne, both of France

[73] Assignee: Etienne Lacroix Tous Artifices S.A., Muret, France

[21] Appl. No.: 207,190

[22] Filed: Jun. 15, 1988

[30] Foreign Application Priority Data

Jun. 16, 1987 [FR] France ..... 87 08385

[51] Int. Cl.[4] ..... F42B 13/00

[52] U.S. Cl. ..... 102/505; 220/4 R; 222/482; 342/12

[58] Field of Search ..... 102/340, 342, 351, 357, 102/505, 438, 439; 342/12; 220/4 R, 4 B; 222/482

[56] References Cited

U.S. PATENT DOCUMENTS

| | | | |
|---|---|---|---|
| 3,335,846 | 8/1967 | Mills . | |
| 3,674,174 | 7/1972 | Crewe | 102/505 |
| 3,757,694 | 9/1973 | Talley et al. . | |
| 3,960,085 | 1/1976 | Abernathy et al. . | |
| 4,406,227 | 9/1983 | Beeker et al. | 102/505 |
| 4,549,489 | 10/1985 | Billard et al. | 102/505 |

FOREIGN PATENT DOCUMENTS

| | | | |
|---|---|---|---|
| 29078 | 11/1979 | European Pat. Off. . | |
| 3327043 | 2/1985 | Fed. Rep. of Germany . | |
| 2436363 | 4/1980 | France . | |
| 2521716 | 8/1983 | France . | |
| 2091855 | 8/1982 | United Kingdom | 102/505 |

*Primary Examiner*—Harold J. Tudor

[57] ABSTRACT

The present invention relates to a container-disperser for chaff constituted by metal strips or by metallized strips, the container-disperser comprising two end plates (130, 140) which are generally parallel and interconnected by spacers (150, 155) suitable for trapping strips of chaff so as to temporarily retain at least a portion of the chaff when the container is ejected from a case, thereby dispersing the chaff in stages.

17 Claims, 4 Drawing Sheets

FIG. 2
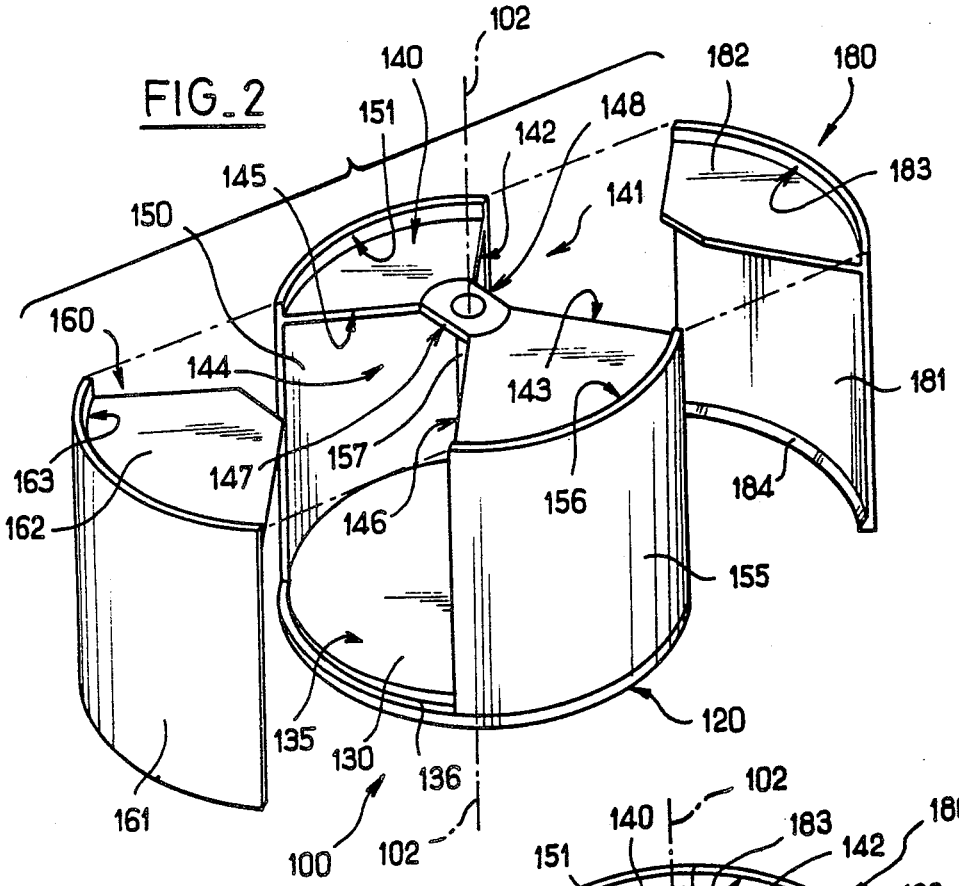
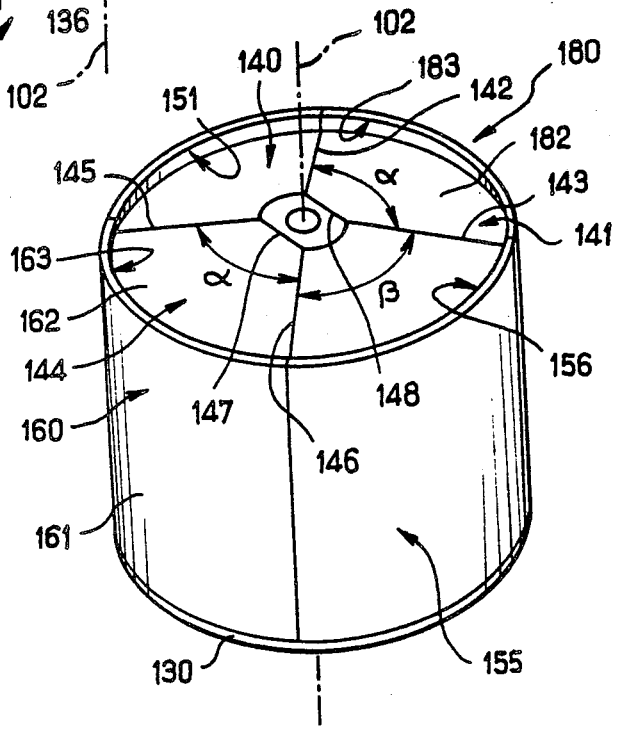
FIG. 3

CONTAINER-DISPERSER FOR CHAFF CONSTITUTED BY METAL STRIPS OR BY METALLIZED STRIPS

The present invention relates to electromagnetic decoys.

More precisely, the present invention relates to a container-disperser for chaff constituted by metal strips or by metallized strips forming a reflecting screen for electromagnetic waves and constituting decoys to distract the guidance systems of weapons using active electromagnetic detectors.

The term "strips" should be understood in a wide sense: it covers metal or metallized needles, tapes, and/or particles of selected length, and in particular metallized glass fibers. Collectively, such strip is known as "chaff" by the person skilled in the art and is generally used for decoying or diverting weapons guidance systems.

BACKGROUND OF THE INVENTION

Accompanying FIG. 1*a* is an exploded view and accompanying FIG. 1*b* is an assembled view showing the structure of a conventional chaff container.

The conventional container 10 shown in the accompanying figures comprises a base 20 and two removable shells 30 and 40 which together define a closed cylindrical housing suitable for receiving a cylindrical block 50 of chaff. The block 50 is represented diagrammatically by dot-dashed lines in FIG. 1*a*. The base 20 is in the form of a disk. Each of the shells 30 and 40 comprises a semi-cylindrical wall 32 or 42 which is coaxial with the disk 20, and a semi-circular end plate 34 or 44 which is fixed to the wall 32 or 42 and which is parallel to the base 20.

The container 10 is generally placed in a cartridge case. The shells 30 and 40 are separated from the base 20 in order to release the block 50 of chaff when the container is ejected from the cartridge case.

Containers of the type illustrated in accompanying Figures 1a and 1b are already widespread and have given good service. However, the Applicant has observed that instead of dispersing the chaff such containers frequently suffer from the drawback of releasing bundles of agglomerated chaff, which is completely useless for distracting weapons guidance system.

The object of the present invention is to eliminate this drawback.

SUMMARY OF THE INVENTION

To this end, the present invention provides a container-disperser for chaff constituted by metal strips or by metallized strips, wherein the container-disperser comprises two generally parallel end plates interconnected by spacers suitable for trapping the strips so as to temporarily retain at least a portion thereof when the container is ejected from a cartridge case, and to give rise to staged strip dispersion.

In a first embodiment of the present invention, the container comprises a body constituted by two generally parallel end plates rigidly interconnected by spacers and at least one removable shell, in which the spacers and the shell(s) together form a continuous envelope between the two end plates.

In a second embodiment of the invention, the container comprises a body constituted by two generally parallel end plates which are rigidly interconnected by spacer rods set back inside the volume circumscribed by the end plates.

BRIEF DESCRIPTION OF THE DRAWINGS

Embodiments of the invention are described by way of example with reference to the accompanying drawings, in which:

FIG. 2 is a diagrammatic perspective view of a container in accordance with a first embodiment of the present invention shown with its shells separated;

FIG. 3 is a diagrammatic perspective view of the Figure 2 container when assembled;

MORE DETAILED DESCRIPTION

Figure 1A:
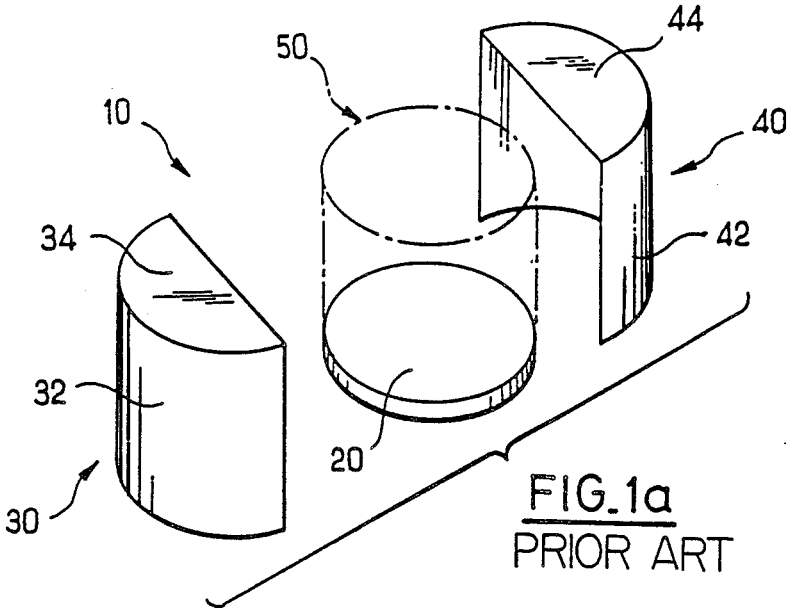
FIG. 1a PRIOR ART
FIGS. 1*a* and 1*b* show the prior art and have already been described.
Figure 1B:
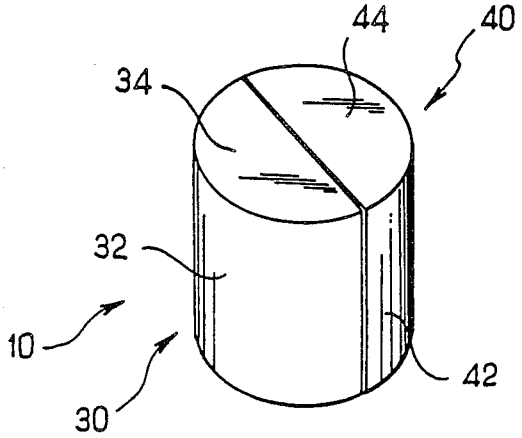
FIG. 1b PRIOR ART

Initially, the description relates to a first embodiment as shown in FIGS. 2 to 5.

The container 100 shown in these figures comprises a body 120 and two removable shells 160 and 180.

The body 120 and the shells 160 and 180 together constitute a closed cylindrical housing centered on an axis 102. The axis constitutes an axis of symmetry for the container.

The body 100 includes two parallel end plates 130 and 140 which are interconnected by two spacers 150 and 155.

The first end plate 130 is in the form of a disk centered on the axis 102 and extending transversely thereto.

The second end plate 140 is constituted by a sheet which is likewise centered on the axis 104 and which extends transversely thereto. The sheet is delimited by an envelope in the form of a disk provided with two openings 141 and 144. The outside radius of the end plate 140 is equal to the outside radius of the end plate 130. The openings 141 and 144 open out to the periphery of the end plate 140. They are diametrically opposite about the axis 102. They are in the form of circular sectors centered on the axis 102. The opening 141 is delimited by radii 142 and 143 at an angle of $\alpha$ to each other. The second opening 144 is delimited by radii 145 and 146 which are preferably at the same angle $\alpha$ to each other. The radii 142 and 143 and 145 and 146, and thus the openings 141 and 144 have a plane of symmetry passing through the axis 102 and extending orthogonally to the section plane of FIG. 5.

The angle $\alpha$ is preferably about 90°.

However, the openings 141 and 144 do not extend all the way to the axis 102 in order to avoid splitting the end plate 140 into two separate parts, in other words the end plate 140 remains as a single piece.

The radially innermost zones of the openings 141 and 144 are thus delimited by generator lines 147 and 148 extending transversely to the above-mentioned plane of symmetry of the openings.

The spacers 150 and 155 are diametrically opposite each other about the axis 102. They are constituted by sectors of a cylinder centered on the axis 102. The radius of curvature of the spacers 150 and 155 is equal to the outside radius of the end plates 130 and 140. The spacers 150 and 152 extend over an angle $\beta$ which is complementary to the angle of the openings 141 and 144. In other words, the angular extent $\beta$ of the spacer 155 is equal to the angle delimited by radii 143 and 146. The second spacer 150 extends over an angle $\beta$ equal to the angle delimited by the radii 142 and 145. The spacers 150 and 155 extend between end plates 130 and 140. However, they extend beyond end plate 140 in the form of annular rims centered on the axis 102 and referenced 151 and 156.

Each of the shells 160 and 180 is in the form of a wall 161 or 181 and a sheet 162 or 182. The walls 161 and 181 are constituted by cylindrical sectors centered on the axis 102 and having the same radius and the same length as the spacers 150 and 155. The walls 161 and 181 extend over angles which are complementary to the angles of the spacers 150 and 155, i..e they extend over the angle $\alpha$. The sheets 162 and 182 are delimited by generally plane circular sectors extending over the same angle $\alpha$. The outline of each of the sheets 162 and 182 is complementary to the outline of the corresponding opening 141 or 144. The sheets 162 and 182 extend transversely to the axis 102.The walls 161 and 181 are connected to the peripheries of the sheets 162 and 182. However, these walls extend beyond the sheets 162 and 182 to form rims centered on the axis 102 and referenced 163 and 183.

In the assembled position, the rims 151, 156, 163, and 183 form a continuous ring centered on the axis 102.

Figure 4:
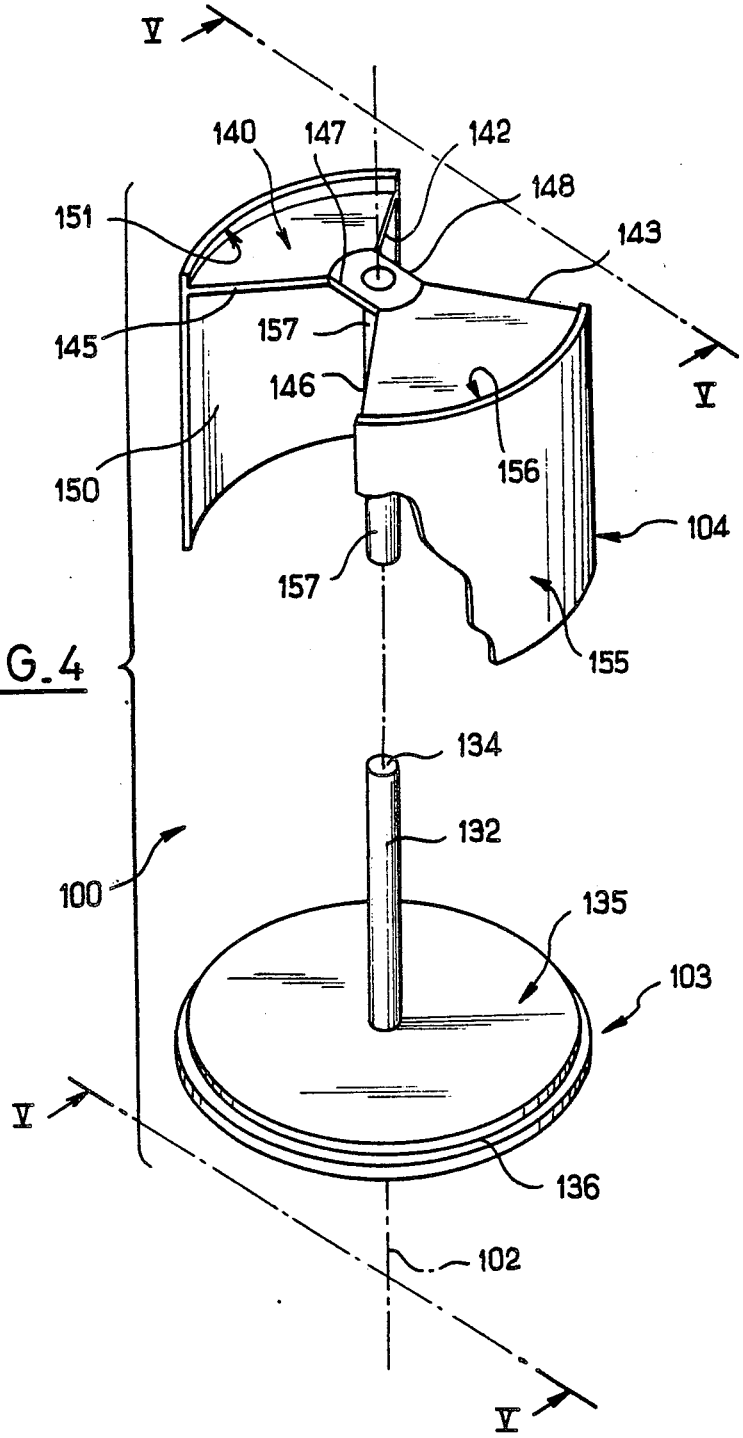
FIG. 4 is a diagrammatic fragmentary exploded perspective view of the same container and it shows, more particularly, the structure of its body.
Figure 5:
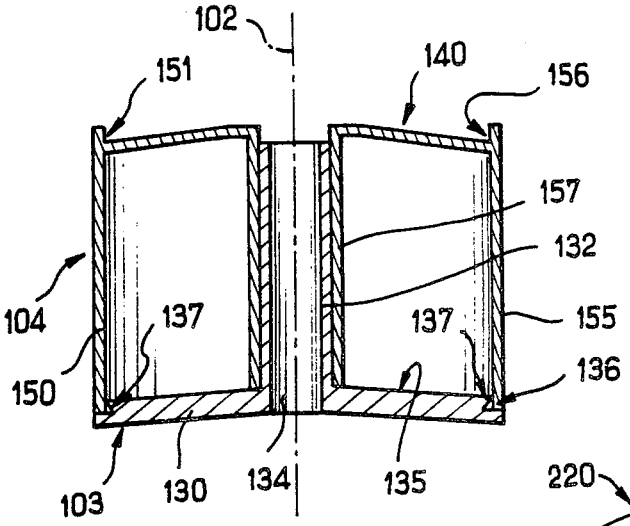
FIG. 5 is a longitudinal section view through the same container on a plane referenced V—V in FIG. 4.

The body 100 is preferably constituted by two elements 103 and 104 as shown in FIG. 4.

The element 103 comprises the end plate 130 and a column 132 which is fixed to the inside face 135 of the end plate 130 and which is centered on the axis 102. The column 132 has a central duct 134.

The second element 104 is constituted by the end plate 140, the two spacers 150 and 155, and a cylindrical tube 157 centered on the axis 102 and fixed to the inside face of the end plate 140 between the two spacers 150 and 155. The tube 157 is suitable for receiving the column 132.

The periphery of the inside surface of the end plate 130 is preferably provided with an annular groove 136 centered on the axis 102. The inside radius of curvature of this groove is equal to the inside radius of curvature of the spacers 150 and 155, and of the walls 161 and 181 in order to receive the ends thereof furthest from the end plate 140 and the sheets 162 and 182.

More precisely, and advantageously, the groove 136 is delimited by a surface 137 extending transversely to the inside surface 135 of the end plate 130, which surface 137 is not parallel to the axis 102 but is frustoconical and circularly symmetrical about the axis 102, converging towards said axis 102 on going away from the surface 135. Further, the shells 160 and 180 are provided on the inside surfaces of the walls 161 and 181 at their ends furthest from the sheets 162 and 182 with rims 184 which are complementary to the above-specified groove 136. By virtue of the above-defined engagement between the groove 136 and the rims 184, the shells 160 and 180 can move axially relative to the body 120 only after the container-disperser has been ejected from a cartridge case.

The body 100 is assembled by placing the column 132 in the tube 157. As shown in FIG. 3, when the shells 160 and 180 are placed on the body 100, they and the body form a closed cylindrical housing suitable for containing a packet or block of chaff. The individual strips of chaff are preferably disposed parallel to the axis 102.

Where appropriate, it is possible to provide one or more cuts through the packet of chaff transversely to the axis 102 through the body 100 and/or through the shells 160 and 180 in order to form strips of chaff having different lengths. In order to diversify the lengths of the strips of chaff, the end plates 130 and 140 are preferably frustoconical. These dispositions have already been described in published French patent application number FR-A-2 521 716 in the name of Applicant and are therefore not described in greater detail below. However, it should be observed that when the strips of chaff extend over the entire length of the spacers 150 and 155, it is preferable for the longest, un-cut strips to be placed facing the shells 160 and 180 so that they are the first to be ejected when the shells 160 and 180 separate.

The container shown in accompanying FIGS. 2 to 5 may be placed in a decoy-launching cartridge case as defined in patent applications Nos. FR-A-2 521 716 and FR-A-2 436 363, or in an equivalent cartridge.

When the container is ejected from the case, the rims 163 and 183 provided on the shells 160 and 180 set up wind "drag" which facilitates separation thereof.

The chaff placed facing the shells 160 and 180 is the first to be dispersed. The chaff placed facing the spacers 150 and 155 is dispersed later on along the trajectory of the container.

The end plate 130 may contain an explosive ejection charge and the column 132 and the tube 157 may contain a time delay fuse and relay as taught in the documents No. FR-A-2 521 716 and FR-A-2 436 363 in order successively to disperse different unit charges of decoys placed in respective containers stacked in a common cartridge.

Figure 6:
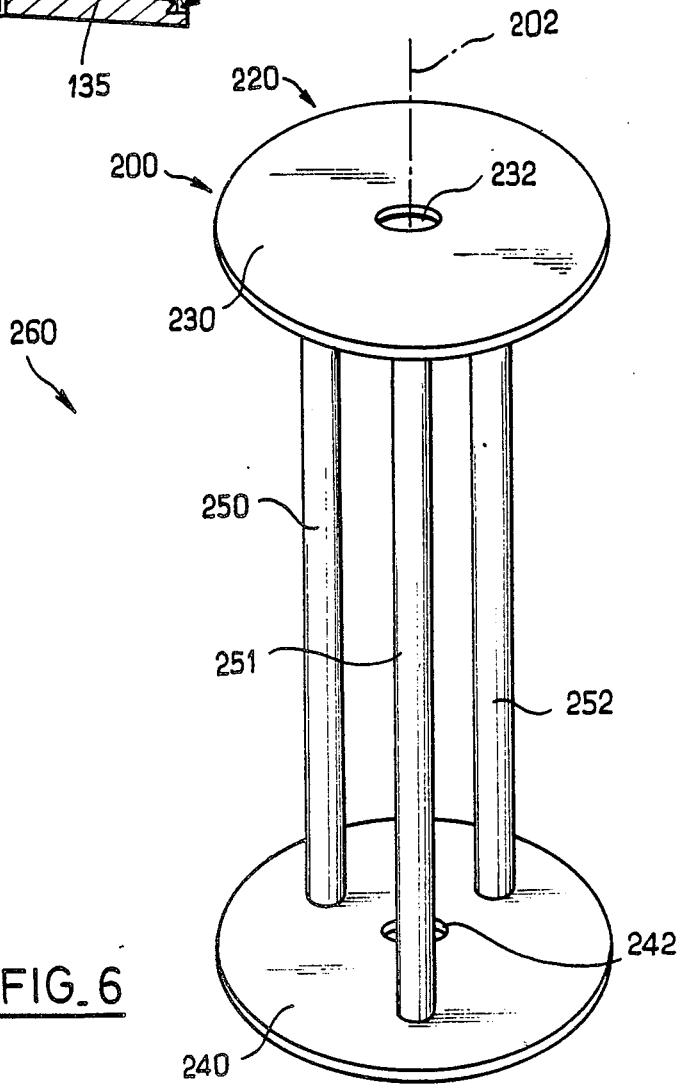
FIG. 6 is a diagrammatic exploded perspective view of a container in accordance with a second embodiment of the present invention.

The second embodiment shown in FIG. 6 is now described.

The container 200 shown in FIG. 6 comprises a body 220.

The body 220 comprises two disk-shaped end plates 230 and 240 which are mutually parallel, which have the same radius, and which are centered on a common axis 202.

The end plates 230 and 240 are interconnected by a plurality of rods 250, 251, and 252 which are parallel to one another and to the axis 202. The rods 250, 251, and 252 are uniformly distributed around the axis 202. In the embodiment shown in FIG. 6, there are three of them, but this number is not limiting. The rods 250, 251, and 252 are set back inside the volume circumscribed by the end plates 230 and 240.

Preferably, each of the end plates 230 and 240 is provided with a central hole 232 or 242 enabling a central cylindrical sleeve to be inserted in alignment with said holes and suitable for receiving a pyrotechnical element such as a delay fuse or a relay, in a manner similar to the column 132.

When the container 200 is ejected from a cartridge case, the chaff is automatically dispersed. However, by virtue of the spacer columns 250, 251, and 252 the chaff is not expelled all at once from the container 200. It is dispersed progressively, thereby covering an optimum area for distracting weapons guidance systems.

Preferably, in the second embodiment, the strips of chaff extend transversely to the axis 202.

Naturally, the present invention is not limited to the embodiments described above but extends to any variant falling within its scope.

We claim:

1. A container-disperser for chaff constituted by metal strips or by metallized strips, wherein the container-disperser comprises:

a body, said body including spacers and two generally parallel end plates rigidly interconnected by said spacers, at least one of the end plates having at least one peripheral opening, and at least one removable shell, said spacers and said at least one removable shell together forming a continuous envelope between the two end plates, wherein said at least one removable shell has a sheet for complementary engagement with said at least one peripheral opening.

2. A container-disperser according to claim 1, including two opposite removable shells.

3. A container-disperser according to claim 1, wherein the two end plates are delimited by generally circular and coaxial perimeters and wherein the spacers, in combination with the at least one removable shell, define a cylindrical envelope having the same radius as the two end plates and coaxial therewith.

4. A container-disperser according to claim 1, wherein said two generally parallel end plates comprise a first end plate which is generally in the shape of a complete disk and a second end plate which is in the shape of a partial disk provided with two diametrically opposite openings in the form of circular sectors opening out to the periphery of said second end plate, said spacers comprising two spacers in the form of diametrically opposite cylindrical sectors interconnecting the two end plates, and two removable shells each constituted by a wall in the form of a cylindrical sector complementary to the spacers and a sheet extending orthogonally to said wall, said sheet being in the form of a circular sector which is complementary to said openings.

5. A container-disperser according to claim 1, wherein each shell subtends an angle of about 90°.

6. A container-disperser according to claim 1, wherein the side walls of the shells extend beyond the sheets extending transversely thereto.

7. A container-dispenser according to claim 1, wherein the end plates are generally frustoconical in shape.

8. A container-dispenser according to claim 1, containing parallel strips of chaff oriented transversely relative to the end plates.

9. A container-disperser according to claim 1, containing a block of chaff including cuts which extend generally parallel to the end plates.

10. A container-disperser according to claim 1, wherein the two end plates are interconnected by a central hollow tube suitable for receiving a pyrotechnical element.

11. A container-disperser for chaff constituted by metal strips or by metallized strips, said container-disperser comprising:

a body including two generally parallel end plates, with a first end plate which is generally in the shape of a complete disk and a second end plate which is in the shape of a partial disk provided with two diametrically opposite openings in the form of circular sectors opening out to the periphery of said second end plate, said body further including two spacers in the form of diametrically opposite cylindrical sectors interconnecting the two end plates, and two removable shells, each constituted by a wall in the form of a cylindrical sector complementary to the spacers and a sheet extending orthogonally to said wall, said sheet being in the form of a circular sector which is complementary to said openings.

12. A container-disperser according to claim 11 wherein each shell subtends an angle of about 90°.

13. A container-disperser according to claim 11 wherein said wall of each shell extends beyond the sheet extending transversely thereto.

14. A container-disperser according to claim 11 wherein the end plates are generally frusto-conical in shape.

15. A container-disperser according to claim 11 containing parallel strips of chaff oriented transversely relative to the end plates.

16. A container-disperser according to claim 11 containing a block of chaff including cuts which extend generally parallel to the end plates.

17. A container-disperser according to claim 11 wherein the two end plates are interconnected by a central hollow tube suitable for receiving a pyrotechnical element.

* * * * *